US006155029A

United States Patent [19]

Jain

[11] Patent Number: 6,155,029

[45] Date of Patent: Dec. 5, 2000

[54] PACKAGING OF HOT MELT ADHESIVES

[76] Inventor: Surendra Jain, 302 Golden Wings Way, Greer, S.C. 29650

[21] Appl. No.: 09/432,700

[22] Filed: Nov. 2, 1999

[51] Int. Cl.[7] ..... B65B 63/08

[52] U.S. Cl. ..... 53/440; 53/122; 53/127; 53/450; 53/550

[58] Field of Search ..... 53/440, 450, 127, 53/550, 122

[56] References Cited

U.S. PATENT DOCUMENTS

| | | | |
|---|---|---|---|
| 3,469,363 | 9/1969 | Berckmoes | 53/440 |
| 3,987,602 | 10/1976 | Stahl | 53/440 |
| 4,054,632 | 10/1977 | Franke | 264/145 |
| 4,137,692 | 2/1979 | Levy | 53/440 |
| 4,748,796 | 6/1988 | Viel . | |
| 4,755,245 | 7/1988 | Viel . | |
| 5,257,491 | 11/1993 | Rouyer et al. . | |
| 5,333,439 | 8/1994 | Bozich et al. . | |
| 5,373,682 | 12/1994 | Hatfield et al. . | |
| 5,669,207 | 9/1997 | Hull | 53/440 |
| 5,715,654 | 2/1998 | Taylor et al. | 53/440 |
| 5,725,820 | 3/1998 | Reynolds et al. . | |
| 5,806,285 | 9/1998 | Rizzieri | 53/440 X |
| 5,819,505 | 10/1998 | Fayolle et al. | 53/440 |
| 5,848,696 | 12/1998 | Christ et al. | 206/447 |
| 5,987,852 | 11/1999 | Bozich et al. | 53/440 |

*Primary Examiner*—Daniel B. Moon
*Attorney, Agent, or Firm*—Hardaway/Mann IP Group

[57] ABSTRACT

The present invention relates to the packaging of a hot melt adhesive in a plastic film to prevent the adhesive from blocking during shipping and storage. The hot melt adhesives of the present invention may be thermoplastic or thermosetting in nature. The films used to wrap the adhesive are flexible in nature and are made of polymer composition, which become part of the adhesive once the adhesive is melted.

13 Claims, 3 Drawing Sheets

PACKAGING OF HOT MELT ADHESIVES

BACKGROUND OF THE INVENTION

1. Field of the Invention

This invention relates to methods for packaging hot melt adhesives, especially hot melt adhesives which exhibit tack at room temperature. The method involves the continuous enrobing of the adhesive in a non-tacky casing at low pressure.

2. Description of the Prior Art

Hot melt adhesives are compositions that are solid at ambient room temperatures. The adhesives are melted at their application temperature, ranging from usually 110° C. to 180° C. (230° F. to 350° F.) at which temperature they are fluid. Those hot melts which have no tack under the conditions of packaging or storage do not require special techniques for packaging unless they are to be shipped or stored in hot climates. They are usually sold in the form of chicklets, pellets, bars etc., and packaged into boxes, bulk bags, etc. The hot melt adhesives which are pressure sensitive or exhibit tack under the conditions of packaging and storage, require special handling. These adhesives consist of compositions that have lower softening points and can stick to each other in storage. They also show cold flow properties under conditions of packaging and storage. Several attempts have been made to package these materials so as to avoid these problems. These adhesives have been supplied in special drums such as those supplied by Grief Brothers, and are lined with silicone-coated surface. The customer using these drums, however, requires either a drum melter or a drum unloader, both of which are very expensive. This method of packaging and storage is only useful and economical for those customers who have a high rate of consumption of adhesives.

Another method used to package these adhesives is in silicone-coated cardboard boxes such as those supplied by Menasha Corporation. These boxes are available in different sizes but are expensive and add substantial cost to the adhesive. Moreover, the filling and handling of these boxes is labor-intensive as well.

A third method commonly used to package these adhesives is in multi-compartment trays. In this method, the multi-compartment (multiple cavity) trays made of plastic or metal are first coated with a powdered wax polymer or copolymer or sprayed with molten wax. The molten adhesives is then poured into the trays while the trays are floating in chilled water or other heat sink. The adhesive is allowed to solidify as the powdered wax fuses with the surface of the block. The newly formed blocks of adhesive are then removed form the cavities in the trays. The unwaxed top surface of the blocks are then either coated with wax or the uncoated surface of the blocks are joined together to make a double-block of adhesive. The block or double-block now has wax on all sides and a non-tacky surface (U.S. Pat. Nos. 4,748,796 and 4,755,245). The wax powder used is so selected that it gives a non-tacky surface and it becomes part of the adhesive when the blocks are melted in the glue pot.

This method has several drawbacks. First, it involves a separate process to coat the trays with powder. Second, there is usually excess powder in the trays which does not stick to the molten adhesive. On cooling, when the adhesive block is removed from the trays, the excess powder falls on the floor creating a slippery and hazardous floor. Third, when the customer handles the blocks, he too experiences the loss of excess powder on his floors, again creating hazardous conditions. Fourth, the powder does not provide any strength to the block of adhesive. When these blocks are packaged into boxes, the blocks of adhesive flatten during shipments in the summer months due to cold flow. U.S. Pat. No. 5,725,820 discloses an improvement wherein a non-tacky polymer is used in place of a powder.

Another method of packaging the hot melt adhesive is co-extrusion. With this method, the non-tacky component of the adhesive is co-extruded as outside surface, and the co-extruded adhesive is pinched off to form pieces of adhesive shaped as pillows. This method works well for making very small sized blocks continuously, but the equipment for the co-extrusion is very expensive. The method also is not practical for making large blocks weighing 1.0 to 2.5 kg (2 to 5 pounds) each, which is the commercially preferred size for many applications.

U.S. Pat. No. 5,257,491 issued to Rouyer, et al. discloses wrapping the solid portions of hot melt material in a plastic packaging film in the form of a wrap, sac or bag. This method is an improvement over prior techniques to make hot melt in block form. However, this method involves two steps, i.e., making solid blocks of adhesive and then wrapping or enclosing them in plastic film.

U.S. Pat. No. 5,333,439 issued to Bozick, et al. discloses a method of wrapping hot melt as a continuous process using a continuous sheet of heat sealable film, the film being patterned with a silicone coating. This method also discloses packaging the adhesive in tubular form, using commercially available chub packaging machinery from the KartridgePak company in Davenport, Iowa.

U.S. Pat. No. 5,373,682 issued to Hatfield, et al. discloses a method of continuous packaging that involves pouring molten hot melt into a cylindrical plastic tube. The patent also discloses the use of commercially available chub packaging machinery from the KartridgePak Company. The chub packaging machine, as disclosed in U.S. Pat. No. 5,373,682, consists of a vertical mandrel lined with a plastic tube. The process involves filling the plastic tube with adhesive, pinching the filled plastic tube, and then cutting the plastic tube where it is pinched. Two disadvantages with this method are realized. One, if the adhesive breaks through the film due to a faulty film, if there is poor sealing when the plastic tube is formed, or if there is a break in the film, the tacky adhesive will get on the sides of the mandrel and drop into the voider rolls. This involves a lot of down-time to clean the adhesive from the tube and voider rolls. Second, any air trapped into the cylinder is difficult to remove, especially with high-viscosity adhesives. Entrapped air causes splattering of hot adhesive when the cylinder is added to a pot of molten adhesive.

BRIEF DESCRIPTION OF THE INVENTION

It is an object of this invention to provide an improved method for forming bricks or tubes of hot melt adhesives covered with a non-tacky coating.

It is a further object of this invention to provide tubes or bricks of hot melt adhesive which are substantially free of air bubbles.

It is a further object of this invention to provide the packaging apparatus which operates continuously and which can be easily cleaned in routine maintenance or after leakage or spillage.

These and other objects may be obtained by pouring hot melt adhesive at an elevated temperature into a continuously moving casing material traveling in a trough having a continually changing profile in the longitudinal direction which causes the casing material to be joined in an overlapping configuration so as to enrobe the hot melt adhesive. The enrobed hot melt adhesive is then chilled and divided into sections by crimping. They may be cut immediately after crimping, or after further cooling. Critical to the invention is to orient the packaging equipment at an angle at which air will be excluded from the hot melt adhesive at the time when the adhesive becomes fully enrobed, while maintaining pressure low enough that the casing around the adhesive will not rupture. Temperature control during the enrobing process is critical to producing a unitary structure without breakthrough.

DETAILED DESCRIPTION OF THE INVENTION

The hot melt adhesives according to this invention are based upon thermoplastic or thermosetting resins which may be of the conventional or pressure sensitive type. Common thermoplastic resins are typically block co-polymers (A-B-A) of styrene with methylene, isoprene, polyethylene and other polyofins. Commonly used thermosetting resins are condensed polymers such as urea formaldehyde, melamine formaldehyde, phenol formaldehyde, polyurethanes and silicone resins. They may be heat cured or chemically cross-linked using a catalyst.

Thermoplastic or thermosetting resins are often blended to include tackifying resins, plastiziers, waxes, antioxidants, and other additives to control melt viscosity, flow, flexibility, adhesion and stability. Examples of tackifying resins are derivatives from wood processing (e.g. tall oil production) and synthetic resins of petroleum and coal tar origins. Aliphatic and aromatic resins find important use in hot melt adhesives. A thorough summary of suitable compositions may be found in U.S. Pat. No. 5,257,491 to Rouyer, et al., which is incorporated herein by reference.

The film or casing is an ethylenically based plastic co- or ter-polymerized with a vinyl, acrylic or methacrylic acid derivative or with monomers such as vinyl acetate, ethylacrylate, methacrylate, methyl methacrylate and copolymers of styrene with butadiene, isoprene or other aliphatic monomers, films of polymers and copolymers of atactic polyalphaolefins, atactic polypropylenes, polyamides, polybutadiene, polycarbonates, polyacrylonitriles, polyesters, polyvinyl alcohol, polyurethanes and blends thereof.

The adhesive which is used depends upon the customer's requirements and, for purposes of this invention, is characterized. by a softening point and by its viscosity at various temperatures. In use and in the process of enrobing, the adhesive must be pumpable at 110° C. to 180° C. (230–350° F.). Ideally, the adhesive is one having a comparatively small temperature difference between the softening point and the pour point.

The casing material to be used is a polymeric film chosen upon basis of the adhesive to be enrobed. The casing material has the following properties: 1) a softening point the same as or at a slightly lower temperature than that of the adhesive; 2) chemical compatibility with the adhesive so that the two may be melted together to form an uniform mixture; and, 3) sufficient film strength to be manipulated in the enrobing process.

Figure 1:
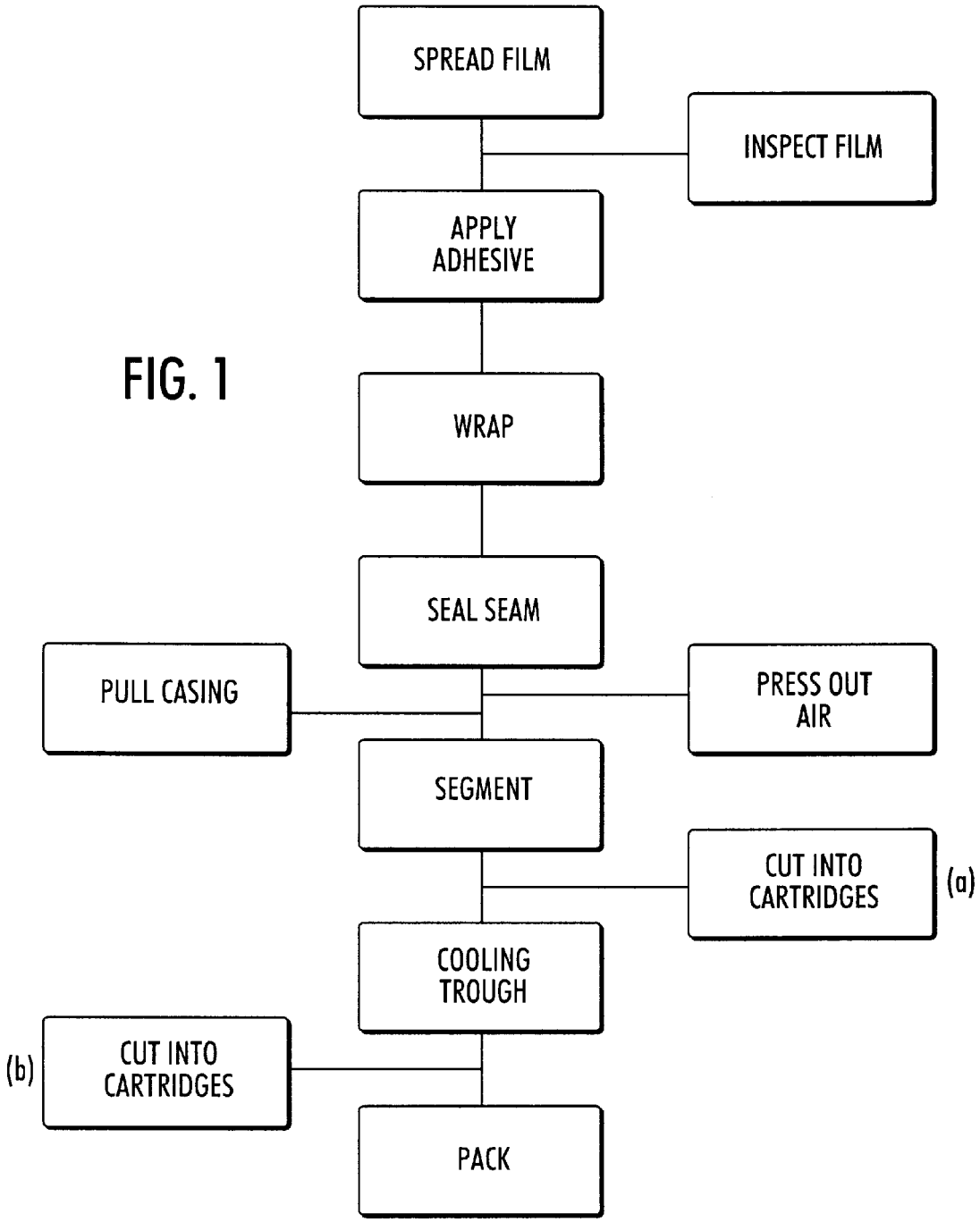
FIG. 1 is a schematic of the invention.
Figure 2:
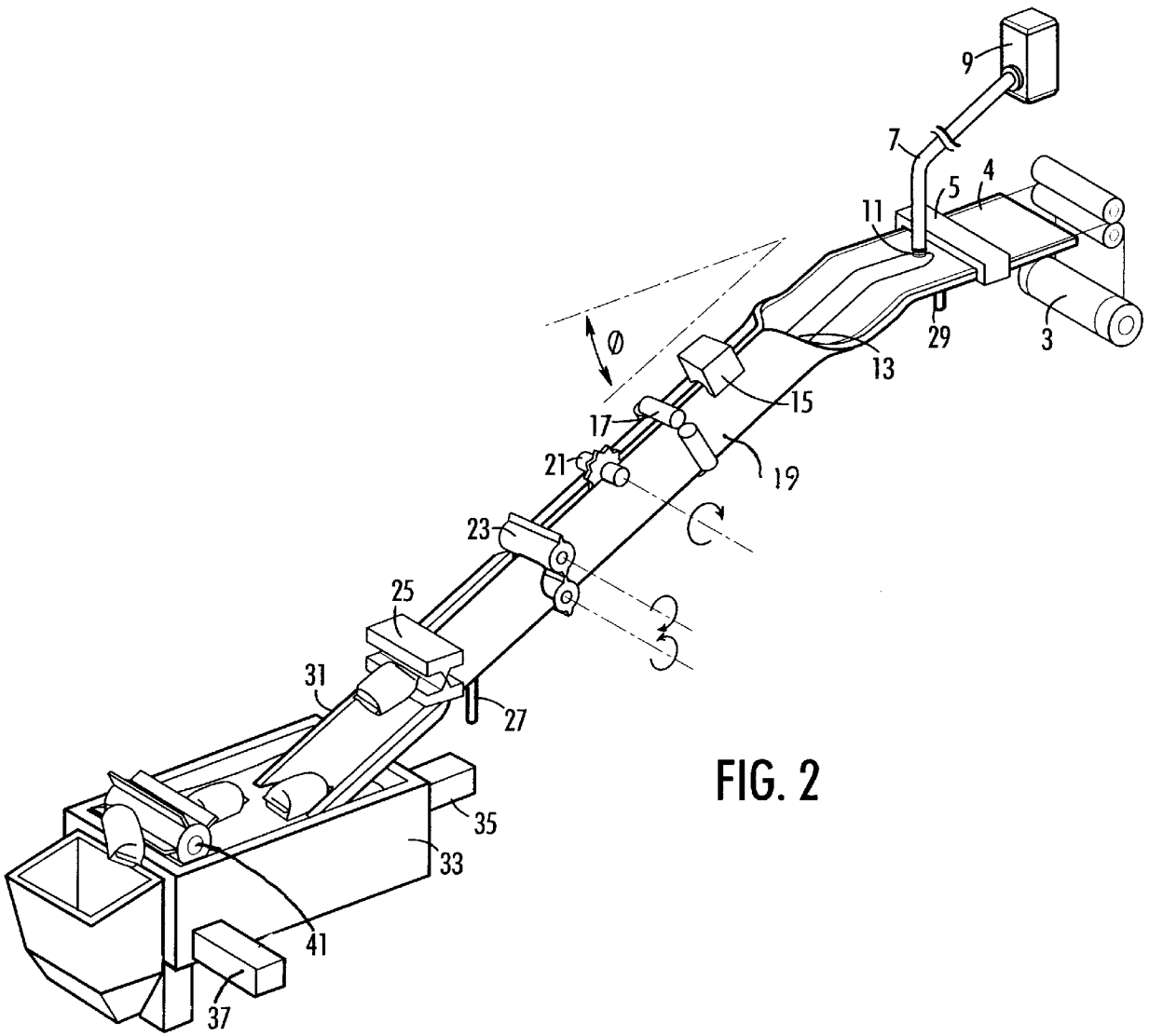
FIG. 2 is a side elevation of the apparatus of this invention.
Figure 3:
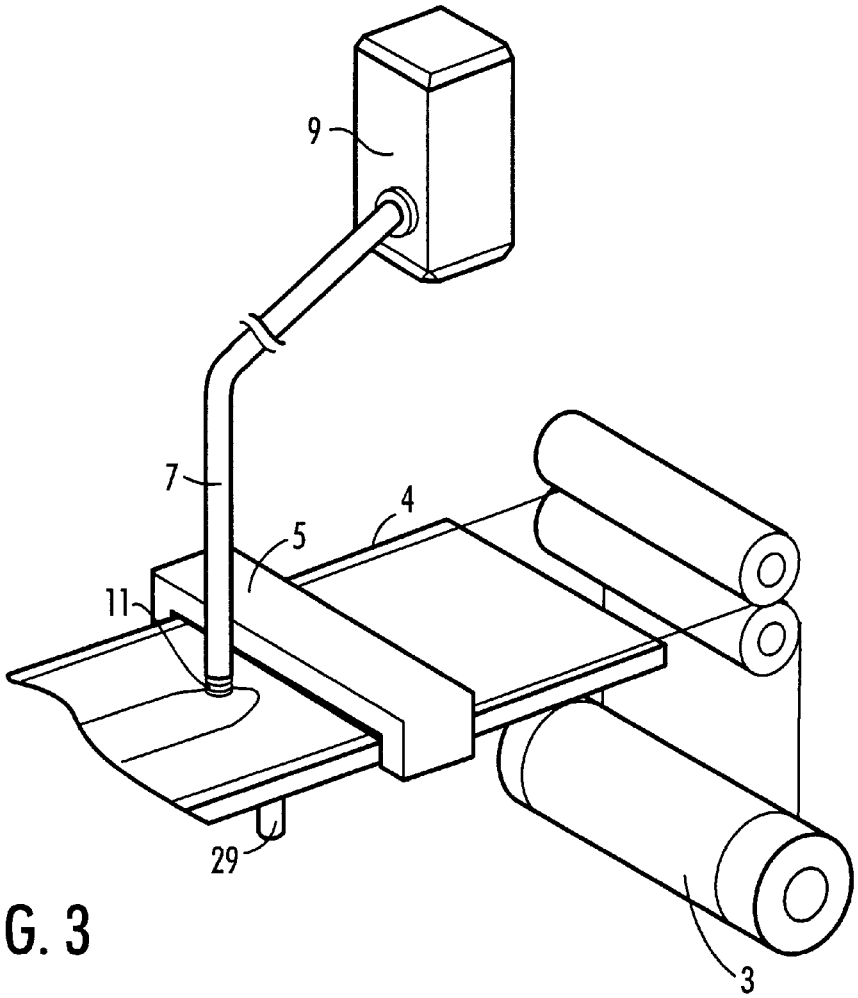
FIG. 3 is a detail of the loading of the adhesive onto the film from which the casing is formed.

The process according to this invention is presented in schematic form in FIG. 1. FIG. 2 illustrates one apparatus for forming the cartridges according to the inventive scheme. The casing is delivered from a roll 3 onto a table 4. Adhesive is delivered to a nozzle 11 above the table through tube 7 from heated kettle 9 at the urging of a pump such as an extrusion pump, gear pump, positive displacement pump, a MOYNO pump or under a head of gas and run onto the moving casing film. The pump should be suitable for delivery of an adhesive having a viscosity of up to 150,000 cps, typically 50,000 to 100,000 cps, without pulsations, or in slugs of the volume required for each brick. It is preferred that at or just before the adhesive is placed on the casing film, the table be relieved to form a trough so that the softening effect of the hot adhesive causes the film to sink into the trough to at least its midpoint c.f. FIG. 3. The casing film is then wrapped around the hot adhesive and overlapped using a forming collar 13 and sealed at sealing station 15 to form a casing containing the adhesive. As the casing is wrapped around the adhesive, the surfaces of the enrobing machine are cooled, except at the immediate region where the overlapping size of the casing at the seam are sealed using heat to weld the seam.

It is imperative that air be excluded from the tube of adhesive. To this end, the table is arranged at an angle θ to the horizontal so that the level of the adhesive fills the casing as it: is being sealed. The angle to the horizontal is selected to ensure that the casing is filled at the time or point when the film overlaps. The angle depends in part upon the viscosity of the adhesive. An angle of about at least 15° to the horizontal is sufficient for some adhesives. Angles as high as about 60° are useable. It is desired to use the minimum angle suitable for the adhesive to avoid excess pressure on the enrobing film.

To ensure that no entrapped air remains within the adhesive, one or more rollers 17 gently compress the casing as the casing proceeds beyond the sealer. At regular intervals after sealing, the intervals being chosen according to the desired dimensions of the adhesive casing, the tube is nip sealed at sealing station 23 to effect the appearance of a string of sausages. The casing is then introduced via a chute 31 into a bath of chilled liquid 33 to increase the rate of cooling. The individual sections or cartridges may be separated by slicing before the cartridges enter the water bath (e.g. by cutters 25) or at the conclusion of their cooling down. One or more rollers 21 may be used to pull the casing through the tunnel.

The enrobed adhesive cartridges which are lighter than water and will float in the bath. It is advisable, therefore, to provide means to direct the cartridges away from the entry point as well as to physically mix the water to improve heat transfer. This may be done using a moving screen, paddle wheels or by directing the water using jets. At the end of the trough, the cartridges are lifted. from the bath by a suitable device 41 and placed on a conveyor where they are drained and dried enroute to a packaging statior. where they are loaded into boxes or sacks for final shipment.

Some adhesive compositions are heavier than water. Typically they include a filler of calcium carbonate ("whiting") or kaolin and must be transported through and out of the tank on an endless belt, preferably of the chain mail type.

The method, according to this invention, requires careful matching of the softening points of the adhesive and of the casing. A good seal during enrobing and a cartridge which melts to form a uniform glue in the pot requires that the hot adhesive soften or begin to melt the casing on introduction of the adhesive but must not break through the casing. The adhesive should assist in forming a seal where the casing sides join which does not leak during subsequent handling of the enrobed adhesive. Advantage is taken of the presence of some adhesive on the overlapping portions of the casing so that, in addition to heat sealing, the ends of the casing are actually glued together.

Temperature control is critical because the casing must be cooled as quickly as possible after the seal is formed to prevent breakthrough further down the production line. This means that the trough and tunnel 19 must be kept cold and must maintain good contact with the cartridge while minimizing drag. Countercurrent cold air may be blown into the trough from the discharge end and/or at locations above the casing downstream of the sealing area. The walls of the trough and tunnel must be smooth and are preferably coated with a low friction material such as teflon or a hard wax.

Powdered lubricants such as waxes are not preferred because they must be recovered before or in the water trough 33.

Figure 4:
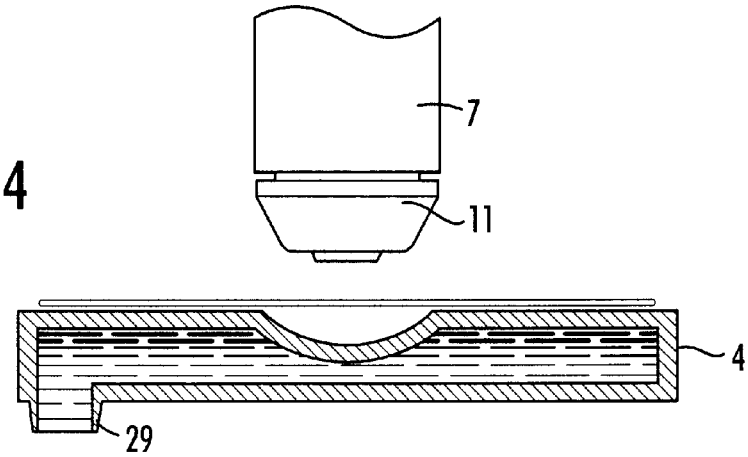
FIG. 4 is a cross-section of the point of loading and the cooling jacket.

It is preferred in one embodiment that the tunnel 19 be jacketed in approximately 360° and that a recirculating cooling system using water or glycol/water, be employed. Suggested entry and exit points for the coolant are shown as 27 and 29 respectively. The water jacket at the area of deposition is shown in FIG. 4. Cooling of the trough at the point of entry of the adhesive allows the bottom half of the casing film to begin cooling before the top has been rolled up and sealed, reducing the risk of breakthrough by the adhesive. Alternatively, the tunnel may be open at the top downstream of the point of seam sealing and cold air blown down into the resultant gap in trough 19. If hot nip rollers 23 are used, they are best heated electrically. Pinch type cutters 25 also may be used to segment the cartridges into individual segments or bricks. The use of water as a transfer fluid to remove heat from the tube before pinching-off is possible but interferes with temperature control of hot sealing devices.

The scanner device 5 is used to ensure that there are no flaws in the film. The scanner may be an optical device such as an infrared scanner or it may be electrical such as a *Tesla coil.*

The integrity of the cartridge may also be tested after formation by adding a UV dye such as fluorescein to the water in tank 33, followed by spray wash of the cartridge after removal from the tank and examination under an ultraviolet light.

The device according to this invention will produce cartridges of a preset diameter, typically between 10 cm and 15 cm (4 and 6 inches) OD, preferably 12.5 cm (5 inches) and in weights from 1 and 3 kg (2–7 pounds), preferably 2 kg (3–5 pounds), depending upon the rate of nipping at nip point 23. The length and weight of the cartridge are varied according to customer requirements.

It is readily seen that many variants upon the device may be made by those skilled in the art to effect the invention disclosed. For example, the table 4 may be disposed at a slant or may already have a trough formed therein when the film first is laid on the table. Nozzle 11 and the filling point may be as close to enrobing collar 13 as possible consistent with formation of a good seal at sealing station 15 and the exclusion of air.

What is claimed is:

1. A process for the continuous production of an enrobed hot melt adhesive cartridge comprising:

a) passing a plastic film across a table having a channel formed therein;

b) depositing a bead of molten hot melt adhesive onto said plastic film above said channel;

c) directing said film downwardly forward at an angle;

d) passing said film and adhesive into a forming collar to form a cylinder while applying pressure to said formed cylinder to exclude air bubbles from said cylinder;

e) simultaneously sealing the film at a point where its edges overlap;

f) rapidly cooling said sealed cylinder within a tubular extension of said forming collar;

g) sealing said cylinder at specified distances to form discrete links;

h) cooling said links to at least about room temperature; in a bath; and, i) passing said enrobed adhesive into a suitable container.

2. The process according to claim 1 further comprising cutting said links into individual cartridges before step 1h.

3. The process according to claim 1 further comprising cutting said links into individual cartridges after step 1h.

4. The process according to claim 1 wherein said sealing steps are selected from the group consisting of a hot air jet, a laser beam, and a heat sealing roller.

5. An apparatus for forming cartridges of a hot melt adhesive enrobed in a non-tacky film comprising:

a) a table having formed therein a channel;

b) means for providing a moving film across said channel in the longitudinal direction;

c) means for applying a hot melt adhesive to said film above said channel;

d) means for forming said film into a cylinder, said means being at an angle downward of said table;

e) means for sealing said cylinder at a line of overlap of said film;

f) means for excluding air from said cylinder;

g) means for cooling said cylinder;

h) means for crimping and sealing said cylinder; and i) means for cutting said cylinder into cartridges.

6. An apparatus according to claim 5 further comprising means for continuously drawing film through said apparatus.

7. An apparatus according to claim 5 wherein said means for forming a cylinder is disposed at an angle to the horizontal selected to allow the adhesive to fill a forming collar to exclude air.

8. An apparatus according to claim 5 wherein said means for forming a cylinder is disposed at an angle between about 15° and about 60°.

9. An apparatus according to claim 5 wherein said means for sealing said cylinder is selected from the group consisting of a hot air jet, a laser beam and a heat sealing roller.

10. An apparatus according to claim 5 further comprising means for cooling said film and adhesive.

11. An apparatus according to claim 10 wherein said means for cooling said film is selected from the group consisting of cold air and cold water.

12. An apparatus according to claim 5 further comprising means for detecting flaws in said film as it is introduced to said table.

13. An apparatus according to claim 12 wherein said means for detecting flaws is selected from the group consisting of optical means and electrical means.

* * * * *